US005630320A

United States Patent [19]

Matsuda et al.

[11] Patent Number: 5,630,320

[45] Date of Patent: May 20, 1997

[54] GAS TURBINE COMBUSTOR AND GAS TURBINE

[75] Inventors: Noriaki Matsuda, Mito; Kunihiro Ichikawa, Hitachi; Shigeru Azuhata, Hitachi; Nobuyuki Iizuka, Hitachi; Yoshikazu Moritomo, Hitachi; Yoshiharu Nakayama, Hitachi; Nariyoshi Kobayashi, Hitachinaka, all of Japan

[73] Assignee: Hitachi, Ltd., Tokyo, Japan

[21] Appl. No.: 357,187

[22] Filed: Dec. 13, 1994

[30] Foreign Application Priority Data

Dec. 15, 1993 [JP] Japan ..... 5-314685

[51] Int. Cl.[6] ..... F02C 1/02

[52] U.S. Cl. ..... 60/749; 60/39.31; 60/39.32

[58] Field of Search ..... 60/39.31, 39.32, 60/737, 749, 748, 747

[56] References Cited

U.S. PATENT DOCUMENTS 3,236,048 2/1966 Spears, Jr. ..... 60/39.74

5,216,885 6/1993 Taniguchi et al. ..... 60/747

8,220,251 3/1994 Ito et al. .

FOREIGN PATENT DOCUMENTS 3-175211 7/1991 Japan .

*Primary Examiner*—Charles G. Freay

*Attorney, Agent, or Firm*—Fay, Sharpe, Beall, Fagan, Minnich & McKee

[57] ABSTRACT

A gas turbine combustor is provides with a stabilizer at a downstream side of a premixing device for premixing and supplying fuel and air into a combustion chamber. The stabilizer has a cylindrical part extending axially from an upstream end thereof to a downstream end and a stabilizing part at the downstream end of the cylindrical part for stabilizing a flame, and the stabilizer is mounted on an inside of the combustor by a plurality of members arranged annularly and secured to the inside of the combustor at their ends, each of the members having a part slidably inserted in an opening of the cylindrical part so as to restrict the stabilizer to move axially while allowing deformation of the stabilizer and another part supporting the upstream end of the cylindrical part so as to restrict radial movement of the stabilizer.

16 Claims, 11 Drawing Sheets

GAS TURBINE COMBUSTOR AND GAS TURBINE

BACKGROUND OF THE INVENTION

This invention relates to a gas turbine combustor and a gas turbine provided with the gas turbine combustor and, particularly to a gas turbine combustor having a stabilizer for stabilizing flames in premixed fuel air combustion and a gas turbine provided with such a combustor.

Of this kind of gas turbine combustor, gas turbine combustors, in which fuel and combustion air are premixed and then burnt, that is, so called premixing combustion is employed, are increasing, as disclosed in JP A 3-175211. The premixing combustion combustor has two advantages at least. One of them is the ability to shorten flames, because premixed fuel and combustion air is injected from a nozzle and it is unnecessary to provide an area for mixing fuel and combustion air at a downstream side of the nozzle. Another is the ability to reduce NOx emission. In the premixing combustion, it is possible to effect combustion under a fuel lean condition. The combustion can reduce NOx emission but lacks stability of flames. Therefore, a stabilizer is provided for the premixing combustion in which fuel is lean. The stabilizer serves for stabilizing flames and reducing NOx emission. The stabilizer is disposed at a position at which the stabilizer is exposed to a high temperature and large temperature difference caused by starting and stopping of the gas turbine, so that large thermal stress is induced in the stabilizer and the stabilizer may be broken.

SUMMARY OF THE INVENTION

An object of the invention is to provide a gas turbine combustor with a stabilizer having a sufficient stabilizing function of flames, which has minimized thermal stresses generated in the stabilizer even if a large temperature difference is applied to the stabilizer and a high reliability, and a gas turbine having the above-mentioned combustor.

Briefly stated, the present invention is characterized in that a stabilizer is provided at a downstream side of a fuel air supply device for supplying fuel air into a combustion chamber such as a premixing device for premixing and supplying fuel and combustion air into the combustion chamber, the stabilizer having a cylindrical part extending axially from an upstream end thereof to a downstream end and a stabilizing part at the downstream end of the cylindrical part for stabilizing a flame, and the stabilizer is mounted on an inside of the combustor so as to restrict the stabilizer to move radially and axially while allowing deformation of the stabilizer caused by to thermal stresses applied therein.

In an aspect of the present invention, the stabilizing part is disposed downstream of and near an outlet port of the premixing device and mounted on the combustor by a mounting device which comprises a plurality of members each radially extending and secured to the inside of the combustor at ends thereof and having a part slidablely fitted in one of holes formed in the cylindrical part to restrict axial movement of the stabilizer while allowing deformation due to thermal stresses and another part supporting an upstream end portion of the cylindrical part of the stabilizer to restrict radial movement of the stabilizer.

It is preferable for the stabilizing part to have a section taken along an axis of the stabilizer that increases in thickness thereof toward a downstream side.

In the stabilizer formed as mentioned above, even if the stabilizer is deformed into such a shape such as a flared bell due to thermal stresses, the stabilizer can be held stablely without restricting deformation of the cylindrical part, whereby minimized thermal stresses are produced in the cylindrical part of the stabilizer even if the combustor is repeatedly subjected to firing and extinguishing. The stabilizer is prevented from being damaged, whereby the reliability of the combustion is raised.

DESCRIPTION OF EMBODIMENTS

A gas turbine combustor for effecting premixing combustion is explained hereunder, referring to FIGS. 1 to 4.

Figure 1:
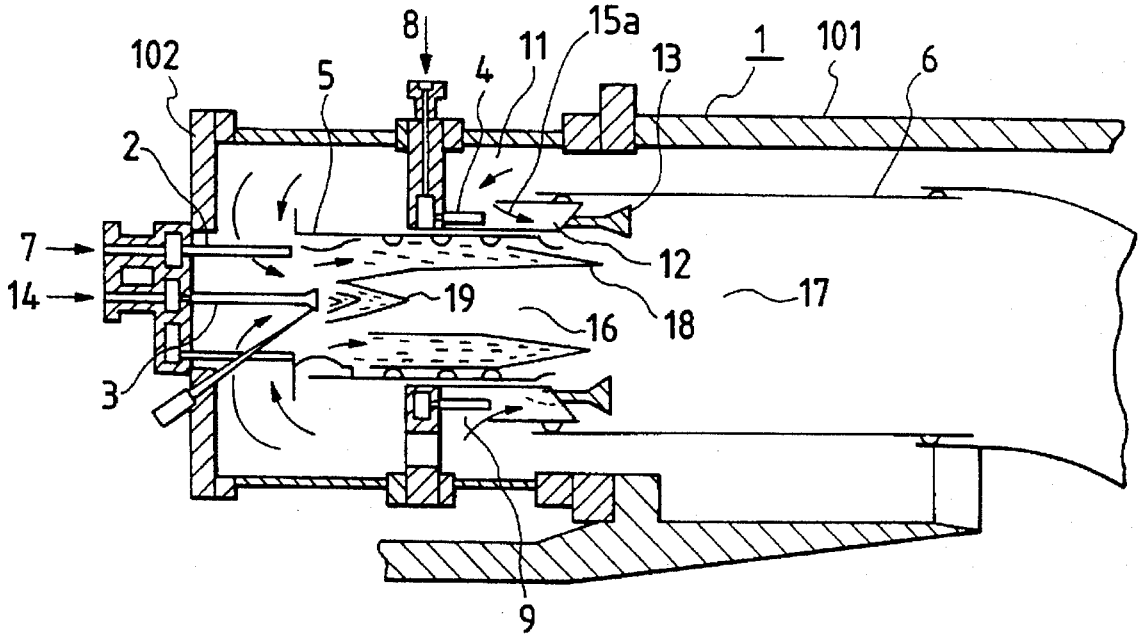
FIG. 1 is a vertical sectional view of a gas turbine combustor for explaining an initial stage combustion state.

In FIG. 1, a combustor 1 has a housing formed of a casing 101 and an end plate 102 fixed thereto. In the inside of the combustor 1, a first stage combustion cylinder 5 and a second stage combustion cylinder 6 are provided for defining a first stage combustion chamber 16 and a second stage combustion chamber 17, respectively. A plurality of first stage fuel nozzles 2 arranged annularly are mounted on the end plate 102 for injecting first stage fuel into the first stage combustion cylinder 5. An auxiliary burner fuel nozzle 3 is mounted on the end plate 102 to be positioned at a center of the plurality of first stage fuel nozzles 2.

Figure 4:
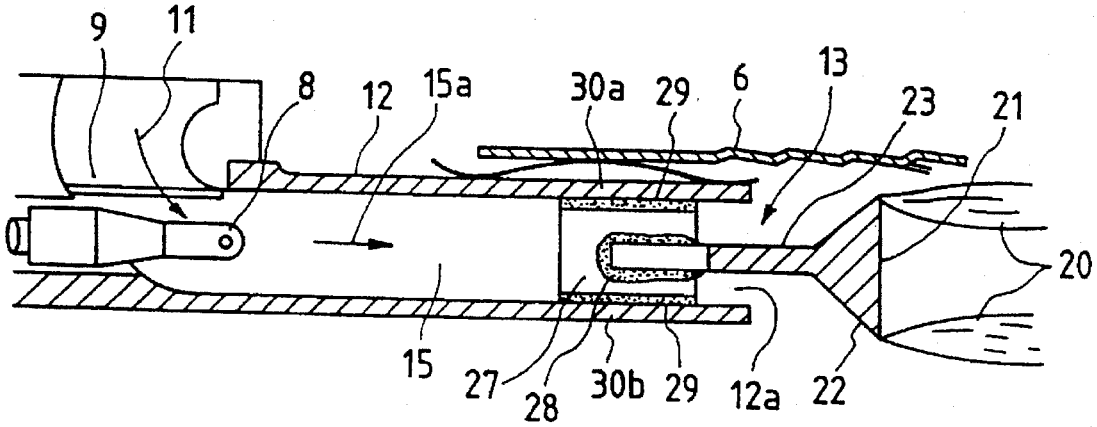
FIG. 4 is a sectional view of a part of the gas turbine combustor showing an example of a mounting portion of a stabilizer to the combustor.

Around an upstream side end portion of the second stage combustion cylinder 6, a premixing device 12 is provided for premixing second stage fuel and combustion air to form a mixture thereof. The premixing device 12 comprises an outer premixing cylinder 30*a* and an inner premixing cylinder 30*b* to form an annular premixture path 15 therebetween, as shown in FIG. 4. Around an upstream side end of the premixing device 12, a plurality of second stage fuel nozzles 4 are provided to be disposed in the premixture path 15, and a plurality of inlets 9 for second stage combustion air are provided.

In the combustor 1, air of high pressure is introduced from a compressor (not shown) into the interior of the combustor 1. A part of the air is introduced in the first stage combustion chamber 16 through inlets and used for first stage combustion of first stage fuel 7 injected through the first stage fuel nozzles 2, and another part is introduced into the premixing device 12 through the inlets 9 to be premixed with second stage fuel 8 injected by the second stage fuel nozzles 4 to produce a premixture or premixture stream 15*a* of the fuel and the air. The premixture stream 15*a* is introduced in the second stage combustion chamber 17 to effect second stage combustion.

A stabilizer 13 is provided on second stage premixture flow near a premixing device outlet 12*a* and at a downstream side of the premixing device outlet 12*a*.

In an operation of the combustor 1, first of all, first stage fuel 7 and auxiliary burner fuel 14 are injected into the first stage combustion chamber 16 through the first stage fuel nozzles 2 and the auxiliary burner fuel nozzle 3 and then fired. Under this condition, a turbine is started to operate. Conditions of flames 18 and 19 generated at this time are illustrated in FIG. 1.

Figure 2:
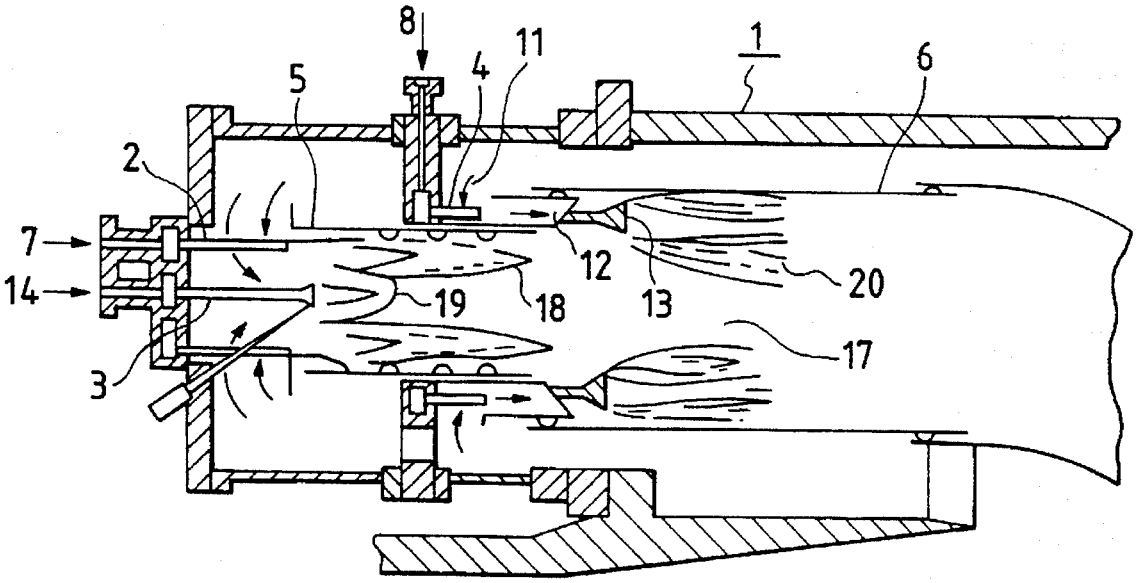
FIG. 2 is a vertical sectional view of a gas turbine combustor for explaining an intermediate stage combustion state.

Next, at a stage in which the gas turbine has reached a certain load, a premixture stream 15*a* in the second stage combustion chamber 17 is ignited. Namely, second stage fuel 8 is mixed with combustion air 11 in the premixing device 12, the mixture is supplied, as the second stage premixture stream 15*a*, into the second stage combustion chamber 17. The second stage premixture stream 15*a* is fired to generate second stage combustion flame 20, as shown in FIG. 2.

In this case, provision of the stabilizer 13 makes it possible to effect stable combustion even if fuel concentration in the second stage premixture stream 15*a* is lean, and to effect stable combustion only by the second stage combustion flame 20 even if the first stage combustion flame 18 is extinguished.

Figure 3:
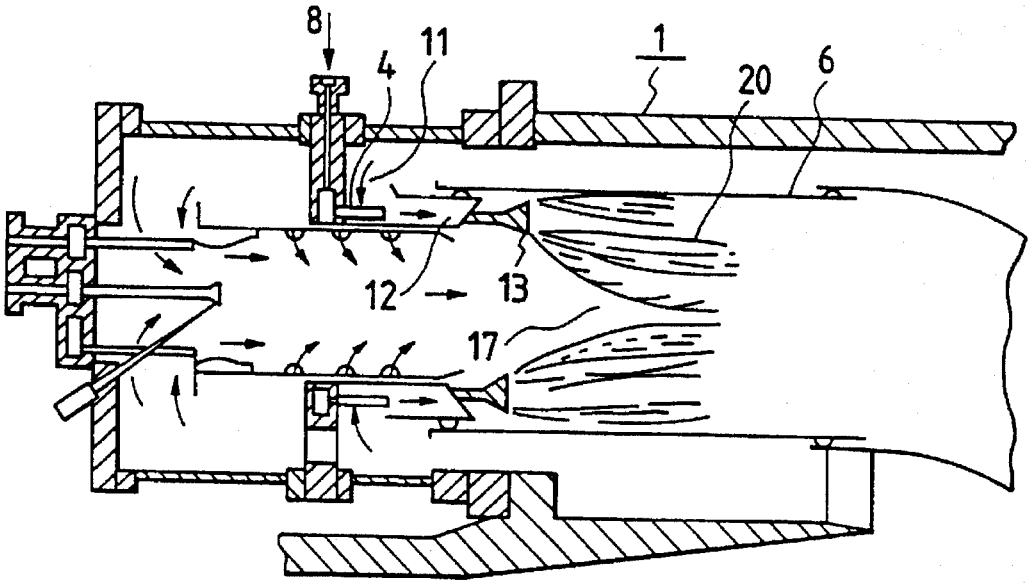
FIG. 3 is a vertical sectional view of a gas turbine combustor for explaining a steady state combustion state.

Further, supply of the auxiliary burner fuel 14 from the auxiliary burner fuel nozzle 3 is stopped, the auxiliary burner fuel 14 is joined to the first stage fuel 7, and they are supplied from the first stage fuel nozzles 2, whereby the auxiliary burner flame 19 is extinguished. Then, the first stage combustion flame 18 flows by vortex flows, so that the flames are not held in the first combustion chamber 16. The first stage combustion flame is stabilized by the second stage combustion flame 20. This condition of the flames is illustrated in FIG. 3.

In this manner, in the gas turbine combustor 1, there are three step combustion processes. The stabilizer 13 has important roles in the combustion processes. One of the roles is to secure stability of combustion in the second and third combustion steps as shown in FIGS. 2 and 3 and another is to reduce NOx concentration in combustion gases which are used for driving the gas turbine.

The stabilizer 13 is mounted on the inside of the combustor 1 such as on the premixing device 12 at its end portion as shown in FIG. 4, for example.

The stabilizer 13 consists of a cylindrical part 23 and a stabilizing part 22 for stabilizing the flame. The cylindrical part 23 has substantially uniform thickness and extends axially, that is, in a length direction of the combustor 1, from an upstream end of the cylindrical part 23 to a downstream end. The stabilizing part 22 extends from the downstream end of the cylindrical part 23 to the downstream side and is shaped in a ring. Preferably, it has an axially taken section shaped as a trapezoid and the thickness of the section increases toward the downstream side of the premixture stream 15*a*. The cylindrical part 23 extends axially from one of the parallel sides of the trapezoid, which is shorter than the other parallel side.

As shown in FIG. 4 which shows flame conditions in normal combustion in addition to the construction of the stabilizer 13, the stabilizer 13 is mounted on the premixing device 12 so that the stabilizing part 22 is positioned at such a position that it is in the premixture stream 15*a*, near the outlet 12*a* of the premixing device 12 and at a downstream side of the outlet 12*a*. The cylindrical part 23 of the stabilizer 13 is fixed to the premixing device 12 by a plurality of members such as flat plates 27 (for example, 16 plates) arranged angularly at regular intervals. The flat plates 27 each are disposed in the flow path of the premixing device 12 so that major surfaces of the flat plate 27 are in parallel to the length direction of the combustor 1, whereby the outlet 12*a* of the premixing device 12 is divided into a plurality of ports. The stabilizer 13 is joined to the outer and inner premixing cylinders 30*a* and 30*b* through the flat plates 27 welded at positions 28 and 29 as shown in FIG. 4.

Figure 5:
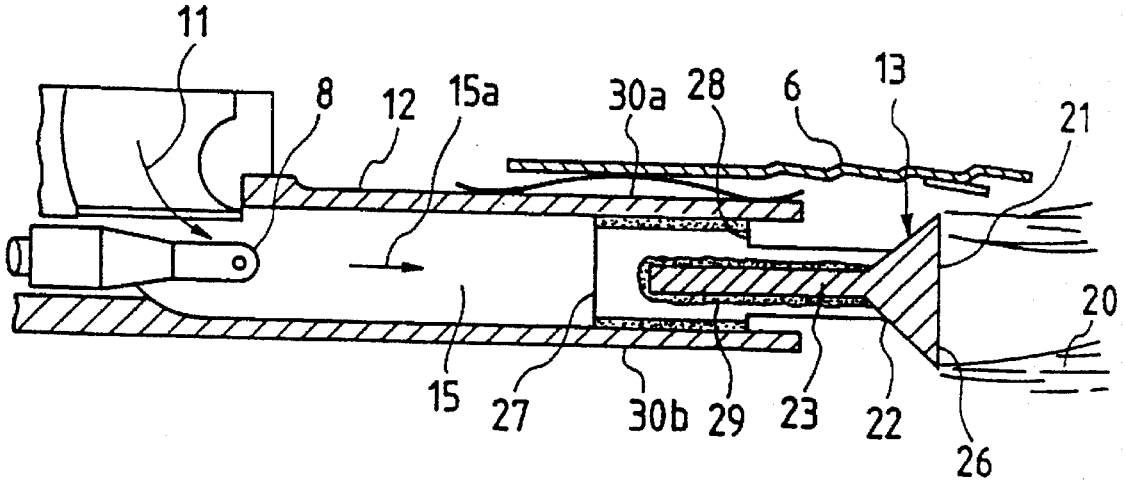
FIG. 5 is a sectional view of a part of the gas turbine showing another example of the mounting portion of the stabilizer.

Another example of the mounting of the stabilizer 13 is shown in FIG. 5. In FIG. 5, a plurality of flat plates 27 are used to connect the stabilizer 13 to the premixing device 12. Each of the flat plates 27 has a long slit for inserting the cylindrical part 23 therein. Each is also welded to the cylindrical part 23 and the outer and inner premixing device cylinders 30*a* and 30*b*, with welded portions 28 and 29 being provided. The slit extends to the stabilizing part 22, the welding portion 29 also extends thereto.

Flames are generated only at an end face 21 corresponding to a bottom side of the trapezoidal section of the stabilizing part 22. Only the end face 21 of the stabilizer 13 is in contact with the flames. Second stage premixture stream 15*a* contacts an inclined side part of the trapezoidal section and outer and inner peripheries of the cylindrical part 23.

The second stage premixture stream 15*a* is not burning, so that the temperature of the stream 15*a* is near the temperature of inflow air 11. Therefore, the temperature of the inclined side portion of the trapezoidal section of the stabilizing part 22 and the temperature of the outer and inner peripheries of the cylindrical part 23 each are relatively low. Therefore, during the operation of the combustor 1, the stabilizer 13 is deformed so that the diameter of the end face 21 of the stabilizing part 22 expands. Namely, during normal combustion, the flame is in contact with the end face 21 of the stabilizer 13 and the second stage premixture stream 15*a* is in contact with the inclined side portions of the trapezoidal section of the stabilizing part 22 and the outer and inner peripheries of the cylindrical part 23, so that the end face 21 of the stabilizing part 22 increases in temperature and the temperature of the outer and inner peripheries of the cylindrical part 23 and the inclined side portion of the trapezoidal section of the stabilizing part 22 decreases as it becomes farther from the end face 21.

Figure 6:
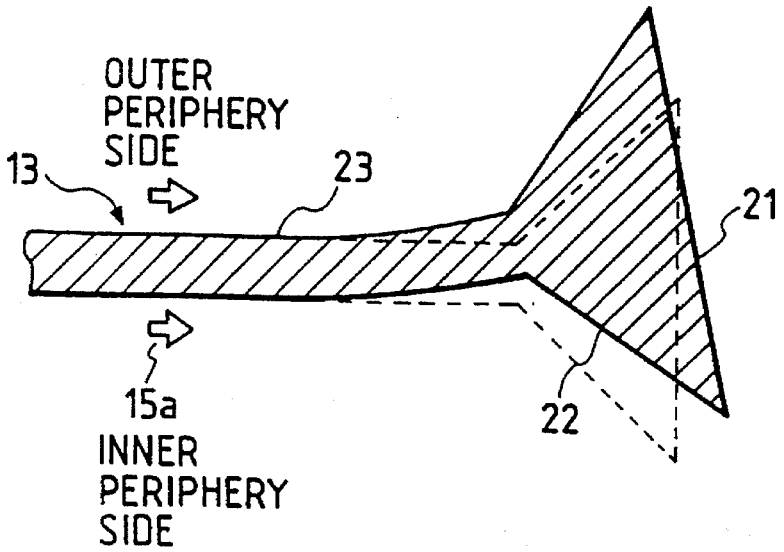
FIG. 6 is a sectional view of the stabilizer for explanation of deformation thereof.

As a result, an end portion of the stabilizer 13 have the higher temperature deforms to a relatively large extent and an upstream side portion of the stabilizer 13 of which the temperature is relatively low deforms to a small extent. Therefore, since the stabilizer 13 is cylindrical as a whole, the stabilizer 13 deforms in a flared bell shape as shown in FIG. 6.

Figure 7:
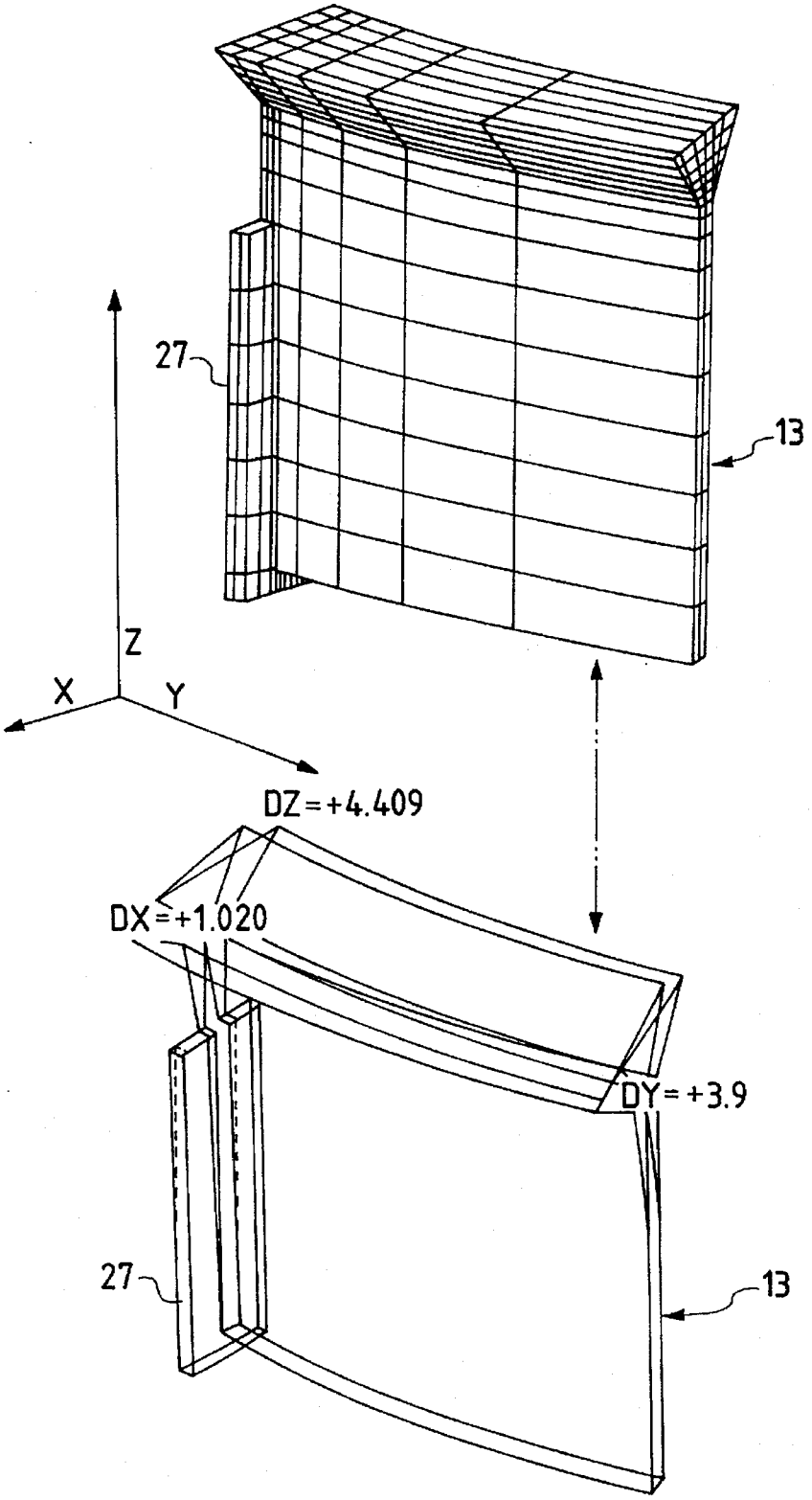
FIG. 7 is an explanation view of deformation of the stabilizer.
Figure 8:
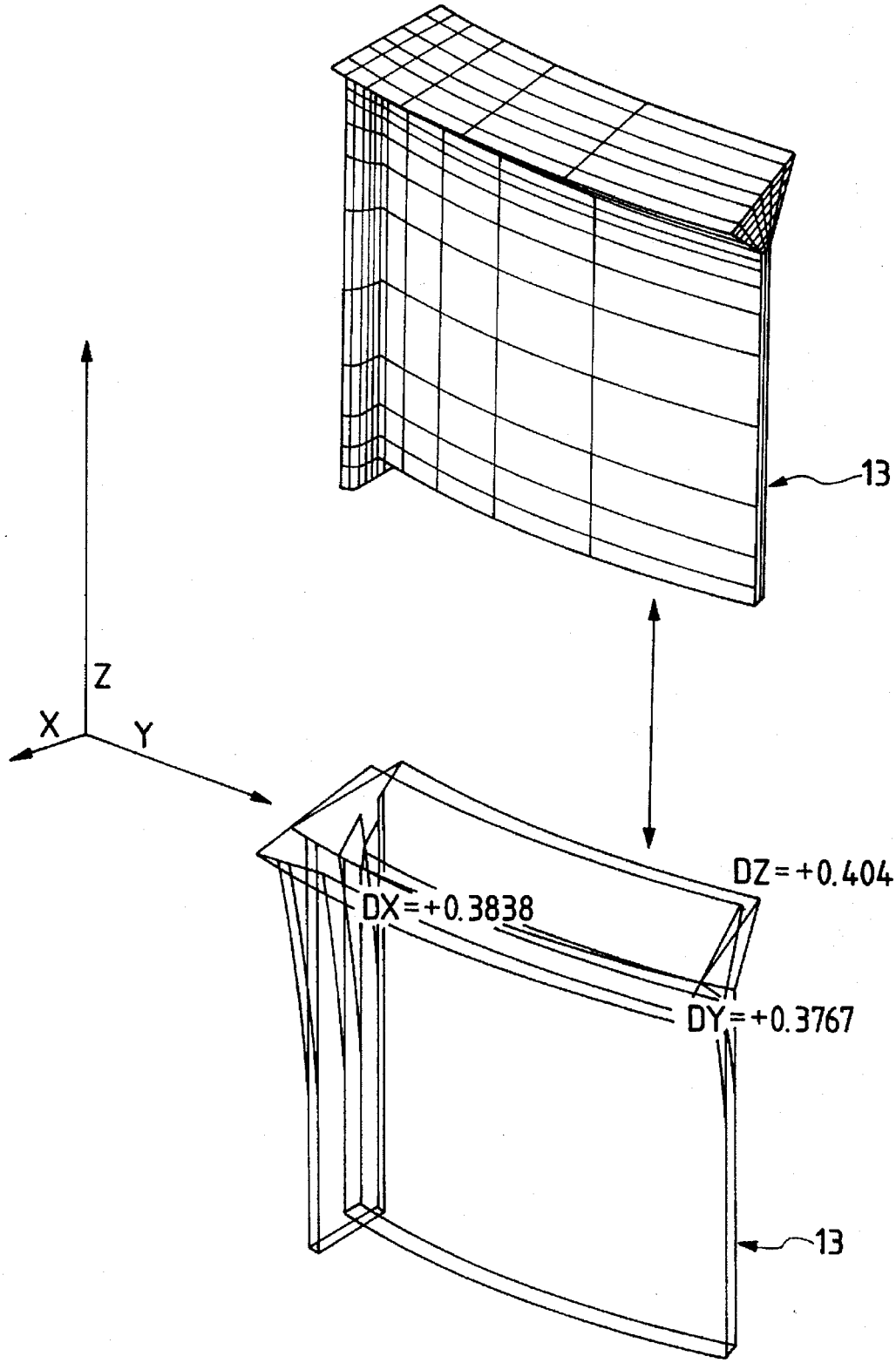
FIG. 8 is an explanation view of deformation of the stabilizer.
Figure 9:
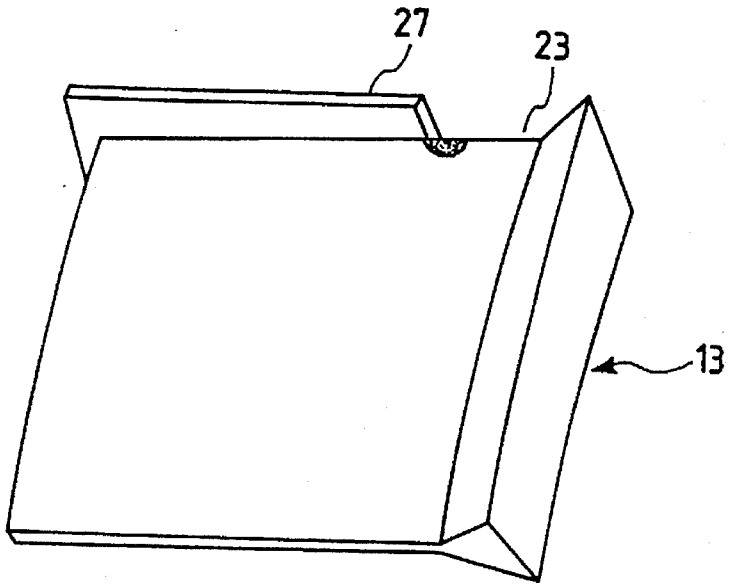
FIGS. 9 and 10 each are an explanation view of stress concentration in the stabilizer mounted on the combustor as shown in FIG. 4.
Figure 10:
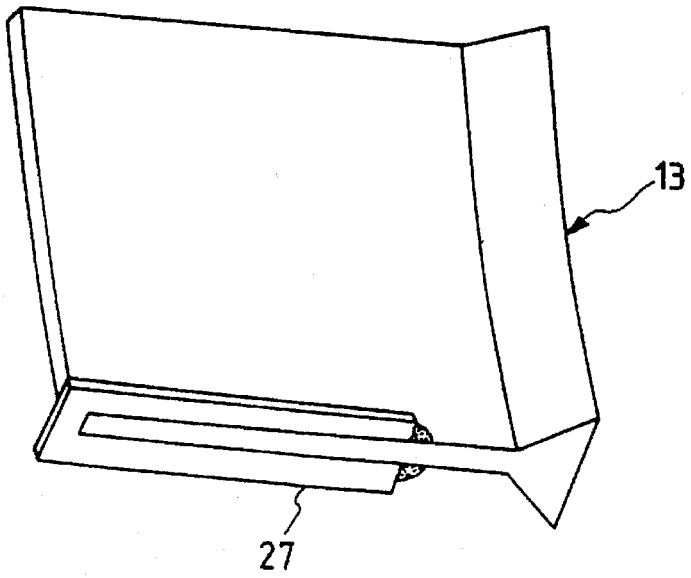
Figure 11:
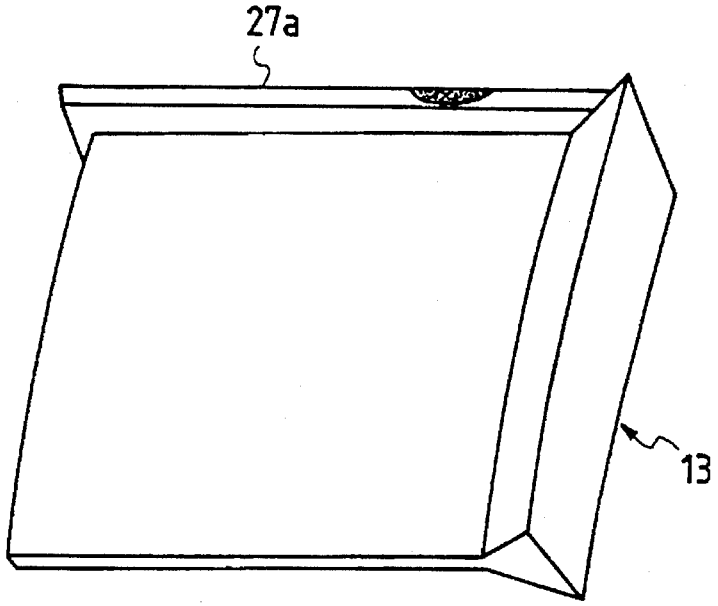
FIGS. 11 and 12 each are an explanation of stress concentration of the stabilizer mounted as shown in Fig. 5.
Figure 12:
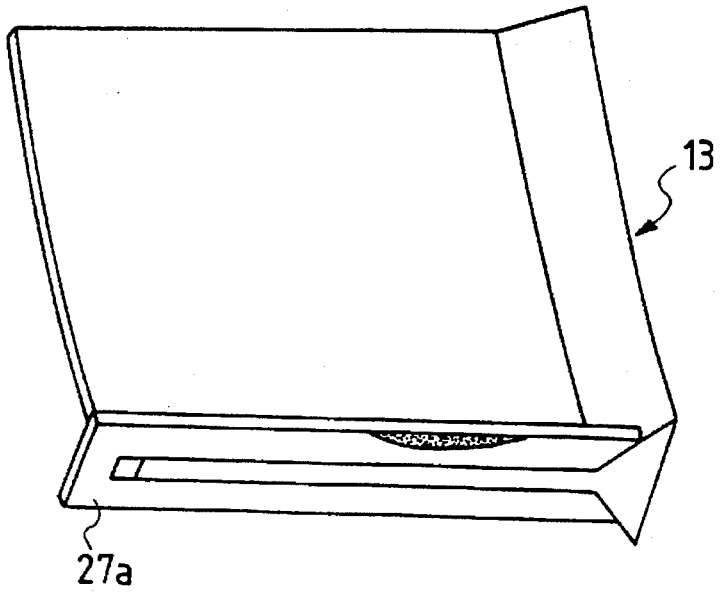

The deformation conditions of the stabilizer 13 fixed to the premixing device 12, as shown in FIG. 4 and in FIG. 5, are shown in FIG. 7 and in FIG. 8, respectively. In FIGS. 7 and 8, dimensions of DX, DY and DZ represent deformation amounts in directions of X, Y, Z, respectively. Positions in which the maximum stress occurs are shown in FIGS. 9 to 12, wherein it is shown in FIGS. 9 and 10 the case of the fixing of the stabilizer 13 as shown in FIG. 4, and the FIGS. 11 and 12 in case of the fixing of the stabilizer 13 shown in FIG. 5.

In any fixing means as mentioned above, the stabilizer 13 deforms outside in a flared bell shape, and since the deformation is restricted by the fixing means such as the flat plate 27, large thermal stress is induced in the stabilizer or the flat plate 27. The maximum stress is induced in the cylindrical part 23 as shown by the black marks in FIGS. 9 to 10 when the stabilizer 13 is fixed as shown in FIG. 4, and in the flat plate 27 as shown by the black marks in FIGS. 11, 12 when fixed as shown in FIG. 5.

Figure 13:
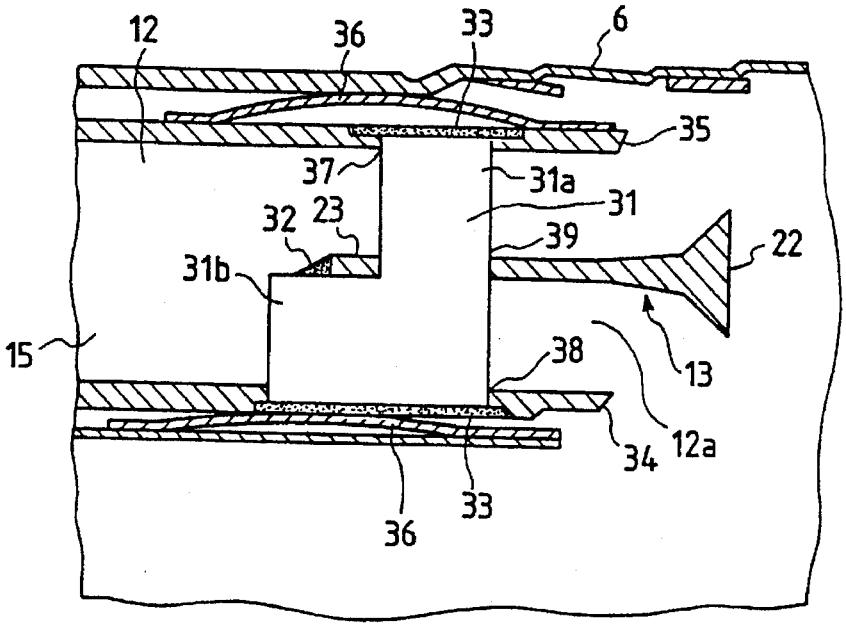
FIG. 13 is a sectional view of a part of the combustor employing a preferable embodiment of a mounting device.
Figure 14:
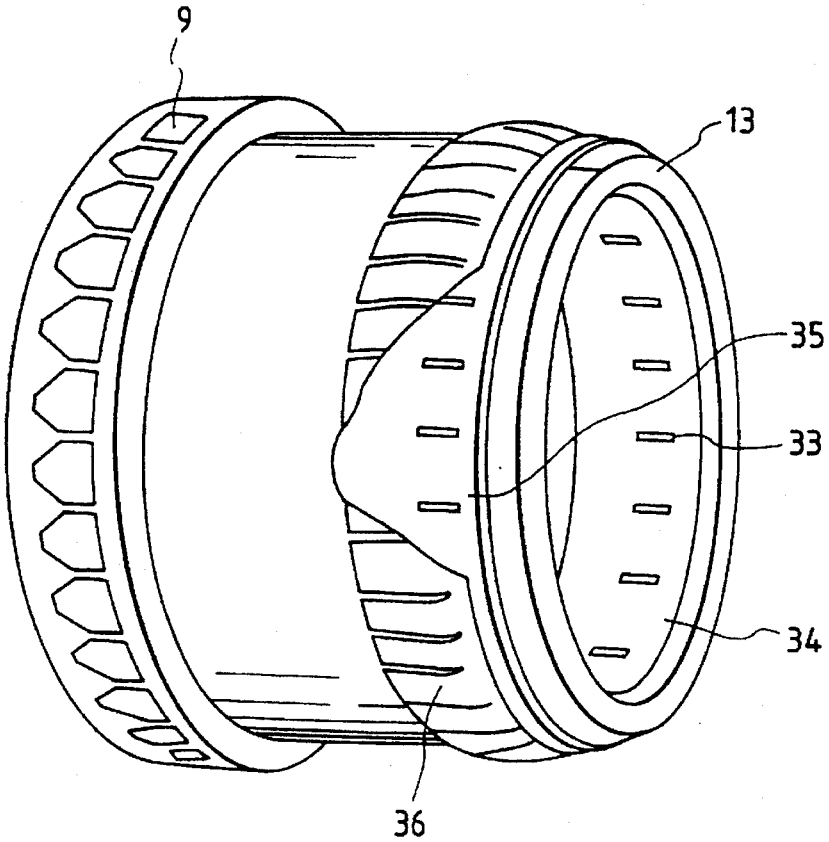
FIG. 14 is a perspective view of a stabilizer and a portion around the stabilizer.
Figure 15:
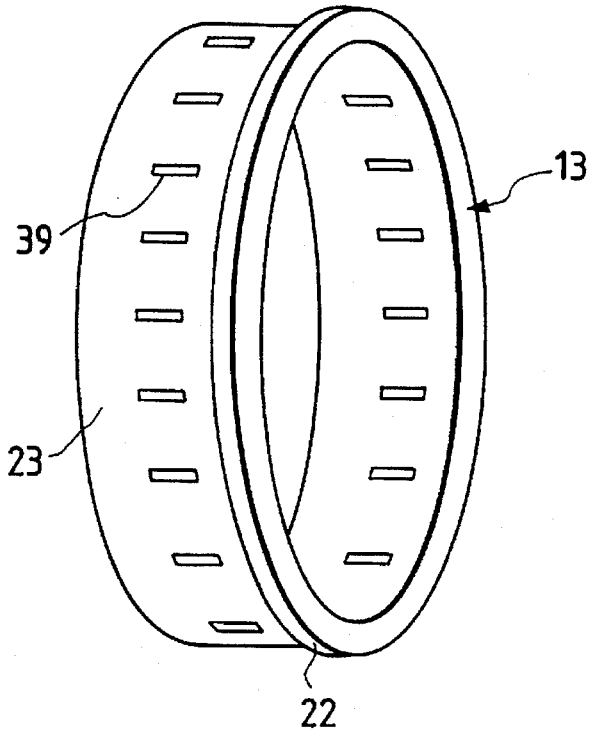
FIG. 15 is a perspective view of the whole of the stabilizer.

Repeating combustion and extinguishing the combustion, cracking may occur by the thermal stress at a position of maximum stress. Further, if the fixing of the stabilizer 13 is broken, the stabilizer 13 may fly and damage the gas turbine thereby. It is necessary to stably and surely mount the stabilizer 13 on the combustor 1. Referring to FIGS. 13 to 16, an embodiment of the mounting device of the stabilizer 13 is explained hereunder. In FIG. 13 which shows a part of the combustor 1 around the mounting portion of the stabilizer 13, a premixing device 12 is of the same construction as in FIG. 4 except that premixing outer and inner cylinders 35, 34 each have fixing openings 37, 38. The premixing outer and inner cylinders 35, 34 each have the slit-like openings 37, 38 arranged annularly at regular intervals around the outlet 12*a* of the premixing passage 15 defined by the cylinders 37, 38. The length direction of the openings 37, 38 is in the axial direction of the premixing device 12. The openings 37 of the premixing outer cylinder 35 extend radially and are aligned with the openings 38 of the remixing inner cylinder 34, respectively. The stabilizer 13 is cylindrical as a whole, as shown in FIGS. 14, 15 and consists of a cylindrical part 23 axially extending from an upstream end to a downstream end and a stabilizing part 22 axially extending from the downstream end toward a downstream side for stabilizing the flame. The cylindrical part 23 has a plurality of slit-like openings 39 (for example, 16 openings) arranged in a circumferetial direction at regular intervals. The length direction of each opening 39 is in the axial direction of the stabilizer 13.

Figure 16:
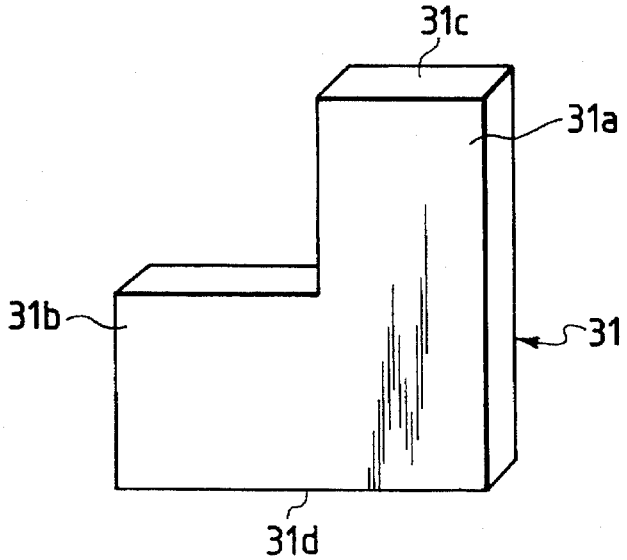
FIG. 16 is a perspective view of a L-shaped plate used for mounting the stabilizer on the combustor.

The stabilizer 13 is mounted on an inside of the combustor 1, for example, on the premixing device 12. A mounting device for mounting the stabilizer 13 on the premixing device 12 includes a plurality of members such as L-shaped plates 31 each of which is shaped as shown in FIG. 16. The L-shaped plate 31 has a radial projection part 31*a* and an axial projection part 31*b*. The L-shaped plate 31 is inserted in the opening 38 with a narrow width end 31*c*. The radial projection part 31*a* is inserted in the opening 39 of the stabilizer 13 and then the narrow width end 31*c* of the part 31 is inserted in the opening 37 of the premixing outer cylinder 35. The narrow width end 31*c* is secured to the premixing outer cylinder 35 by welding. The wider width end 31*d* is secured to the premixing inner cylinder 34 by welding. The axial projection part 31*b* is fitted in the inside of the cylindrical part of the stabilizer 13 so as to support the inside of the cylindrical part 23, thereby to restrict radial movement of the stabilizer 13. The upstream end of the cylindrical part 23 of the stabilizer 13, which upstream end is free from deformation due to thermal stress, is welded to the axial projection part 31*b* although the welding is not necessarily needed for mounting the stabilizer 13. The welding can prevent vibrations of the stabilizer 13. It is necessary that the radial projection 31*a* is slidablely inserted in the opening 39 of the stabilizer 13 to allow deformation which may be caused in the stabilizer 13 due to thermal stresses. The insertion of the radial projection in the opening 39 can surely prevent the stabilizer 13 from axially moving.

In a combustor constructed in this manner, even if the stabilizer 13 is deformed in a flared bell due to thermal stresses, the deformation part is free from restriction, so that it can freely deform. Therefore, since stresses, which may be caused due to firing and extinguishing of combustion gas which are repeated in the combustor are minimized in the stabilizer 13, the stabilizer 13 or surrounding parts such as the fastening parts are not broken, which result in an increase in the reliability of the power plant.

Around the outlet 12*a* of the premixing device 12, seal plates 36 are provided for sealing air passing through annular gaps between the second stage combustion cylinder 6 and the premixing outer cylinder 35 and between the premixing inner cylinder 34 and the first stage combustion cylinder 5, and for supporting the end portion of the premixing device 12.

Figure 17:
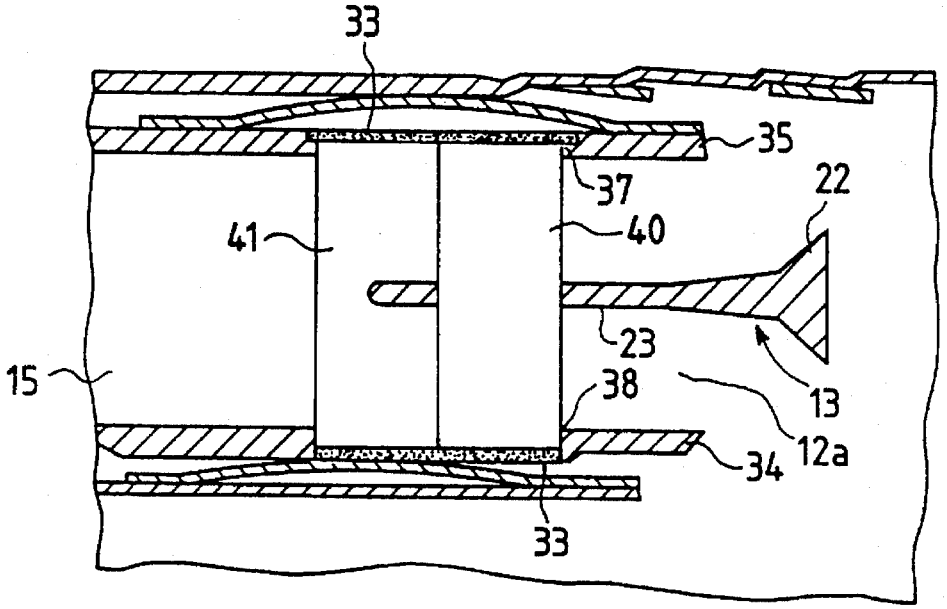
FIG. 17 is a sectional view of a part of the combustor employing another embodiment of the mounting device.
Figure 18:
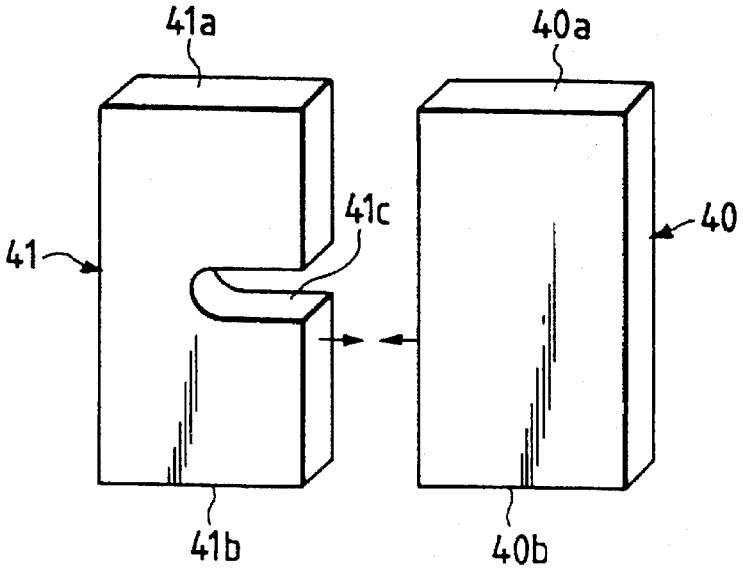
FIG. 18 is a perspective view of member parts used for the mounting device as shown in FIG. 17.

Another embodiment of the mounting device for mounting the stabilizer 13 on the combustor 1 is described referring to FIGS. 17 and 18.

In FIGS. 17 and 18, the mounting device includes two flat plates 40, 41 instead of the L-shaped plate. The plates 40 each are slidablely inserted in the slit-like opening 39 of the cylindrical part 23 of the stabilizer 13 and both ends 40*a*, 40*b* of each plate 40 are secured to the premixing outer and inner cylinders 35, 34 by welding 33. The stabilizer 13 can move radially but not move axially by the flat plate 40. The flat plate 41 is elongate and has a groove 41*c* extending perpendicularly to the length direction. The flat plate 41 is inserted in the slit-like openings 37, 38 of the premixing outer and inner cylinders 35, 34 and secured to the cylinders 35,34 by welding 33. The upstream end of the cylindrical part 23 of the stabilizer 13 is inserted in the groove 41*a* so that the stabilizer 13 is restricted to move radially.

In assembly, first, the flat plate 41 is assembled in the premixing device 12, then the stabilizer 13 inserted in the groove 41*a*, and finally, the flat plate 40 is assembled in the premixing device 12.

This mounting device as shown in FIG. 17 and FIG. 18 has the same function as the previously mentioned mounting device as shown in FIG. 13.

In the above-mentioned embodiments, flat plates are used for mounting the stabilizer on the inside of the combustor, so that the rigidity of the premixing device is increased, whereby deformation by pressure or hydraulic force applied on the premixing device can be prevented. The flat plates divide the annular premixture passage into the plurality of outlet ports, whereby the premixture stream can be rectified and combustion efficiency can be raised.

Figure 19:
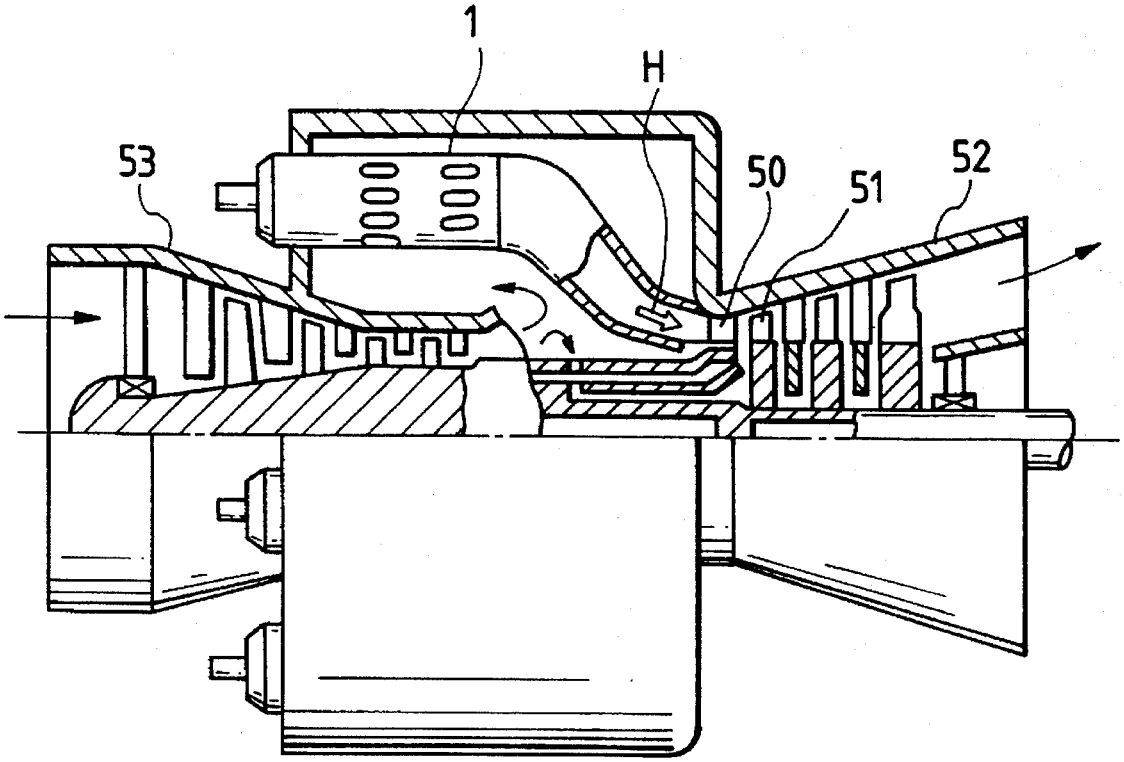
FIG. 19 is a sectional view of a gas turbine.

A gas turbine to which the present invention is to be applied is illustrated in FIG. 19.

In FIG. 19, the gas turbine comprises a gas turbine 52 having stationary blades 50 and moving blades 51, a compressor 53 connected to the gas turbine 52 for compressing air and introducing compressed air into a combustor 1 for combustion and cooling, and a combustor 54 for generating combustion gas of high temperature and high pressure.

A part of the compressed air delivered from the compressor 53 is introduced into the combustor 1 and used for combustion of fuel in the combustion chamber. Another part of the compressed air is used as cooling air for cooling liners of the combustor 1 and the blades 50, 51 of the turbine 52.

The combustion gas H of high temperature and high pressure is injected onto the moving blades 51 through the stationary blades 50 to drive the turbine 52. A generator (not shown), in general, is connected to a shaft 55 of the gas turbine 52 and driven by the shaft 55 to generate electric power.

The combustor 1 associated in the gas turbine may be constructed according to any one of embodiments previously mentioned.

What is claimed is:

1. A gas turbine combustor having a combustion chamber for effecting combustion therein, a fuel air supply device for supplying fuel and combustion air into said combustion chamber, the supplied fuel air being burnt in said combustion chamber to generate a flame, and a stabilizer for stabilizing the flame, characterized in that said stabilizer is cylindrical as a whole and comprises a cylindrical part axially extending from an upstream end thereof and to a downstream end and a stabilizing part axially extending from said downstream end of said cylindrical part toward a downstream side for stabilizing the flame, said cylindrical part havinq a plurality of openinqs arranqed at intervals in a circumferential direction of said cylindrical part, and a mounting device is disposed in fuel and combustion air in said fuel air supply device and mounted for mounting said stabilizer on an inside of said combustor, said mounting device including a plurality of members each secured to the inside of said combustor and slidably inserted in one of said plurality of openings and connected to said cylindrical part so as to restrict axial and radial movement of said stabilizer while allowing deformation of said stabilizer due to thermal stress caused therein.

2. A gas turbine combustor according to claim 1, wherein said plurality of members each are a flat plate having a section inserted slidably in one of said plurality of openings in said cylindrical part to restrict an axial movement of said stabilizer while allowing the deformation and another section supporting an inside of said cylindrical part to restrict a radial movement of the stabilizer.

3. A gas turbine according to claim 1, wherein said plurality of members each are a pair of flat plates secured to the inside of said combustor at their ends, one of said pair of flat plates being slidably inserted in one of said openings in said cylindrical part to restrict an axial movement of said stabilizer while allowing deformation of said stabilizer, and another of said pair of flat plates having a groove between the ends thereof receiving therein an upstream end of said cylindrical part to restrict a radial movement of the stabilizer.

4. A gas turbine combustor having a combustion chamber for effecting combustion therein, a fuel air premixing device for premixing and supplying fuel and combustion air into said combustion chamber, the supplied fuel air being burnt in said combustion chamber to generate a flame, and a stabilizer for stabilizing the flame, characterized in that said stabilizer comprises a cylindrical part axially extending from an upstream end to a downstream end and having a plurality of through holes arranged in a circumferential direction with intervals, and a stabilizing part axially extending from the downstream end of said cylindrical part toward a downstream side and having a section which is taken along an axis of said stabilizer and increases in thickness thereof toward a downstream side, and said stabilizer is disposed so that said stabilizing portion is positioned near and downstream of an outlet of said fuel air premixing device, and mounted on an inside of said combustor by a mounting device, said mounting device comprising a plurality of members each radially extending and secured to the inside of said combustor at ends thereof and having a section slidably fitted in one of said holes formed in said cylindrical part to restrict axial movement of said stabilizer while allowing deformation due to thermal stress and another section to restrict radial movement of said stabilizer.

5. A gas turbine combustor according to claim 4, wherein said another section of each of said plurality of members is formed as a support portion supporting an inside of said cylindrical part at an upstream side of said hole.

6. A gas turbine combustor according to claim 4, wherein said plurality of members each are a flat plate, major surface sides of which are in an annular fuel air stream passage of said fuel air premixing device to divide said passage into a plurality of passages.

7. A gas turbine combustor according to claim 4, wherein said plurality of members each consists of two member parts separated from each other, one of which is slidable inserted in said hole to restrict axial movement of said stabilizer and another member part is engaged with the upstream end of said cylindrical part to restrict radial movement of said stabilizer.

8. A gas turbine combustor according to claim 7, wherein said another member part has a slit axially extending and inserting therein said upstream end of said cylindrical part.

9. A gas turbine combustor according to claim 4, wherein said plurality of members each are a L-shaped flat plate, one section of which passes through one of said holes to restrict axial movement of said stabilizer while allowing deformation thereof and another section is disposed in an inside of said cylindrical part to support it in the radial direction.

10. A gas turbine combustor according to claim 4, wherein said fuel air mixing device comprises outer and inner cylinders defining therebetween a fuel air mixture passage, said plurality of members each extending axially and being secured to said outer and inner cylinders at ends thereof.

11. A gas turbine combustor according to claim 10, wherein said plurality of members each are a flat plate disposed in said fuel air mixture passage so that major surface sides extend radially and are in parallel to the axis of said stabilizer, said plurality of members dividing said fuel air mixture passage into a plurality of passages arranged annularly.

12. A gas turbine provided with a combustor having a combustion chamber for effecting combustion therein, a fuel air supply device for supplying fuel and combustion air into said combustion chamber, the supplied fuel air being burnt in said combustion chamber to generate a flame, and a stabilizer for stabilizing the flame, characterized in that said stabilizer is cylindrical as a whole and comprises a cylindrical part axially extending from an upstream end thereof and to a downstream end and a stabilizing part axially extending from said downstream end of said cylindrical part toward a downstream side for stabilizing the flame, said cylindrical part having a plurality of openings arranged at internals in a circumferential direction of said cylindrical part, and a mounting device is disposed in fuel and combustion air in said fuel air supply device and mounted for mounting said stabilizer on an inside of said combustor, said mounting device including a plurality of members each secured to the inside of said combustor and slidably inserted in one of said plurality of openings and connected to said cylindrical part so as to restrict axial and radial movement of said stabilizer while allowing deformation of said stabilizer due to thermal stress caused therein.

13. A gas turbine combustor according to claim 12, wherein said plurality of members each are a flat plate having a part inserted slidably in one of said plurality of openings in said cylindrical part to restrict an axial movement of said stabilizer while allowing the deformation and another part supporting an inside of said cylindrical part to restrict a radial movement of the stabilizer.

14. A gas turbine provided with a combustor having a combustion chamber for effecting combustion therein, a fuel air supply device for supplying fuel and combustion air into said combustion chamber, the supplied fuel air being burnt in said combustion chamber to generate a flame, and a stabilizer for stabilizing the flame, characterized in that said stabilizer comprises a cylindrical part axially extending from an upstream end to a downstream end and having a plurality of openings arranged in a circumferential direction with intervals, and a stabilizing part axially extending from the downstream end of said cylindrical part toward a downstream side and having a section which is taken along an axis of said stabilizer and increases in thickness thereof, and said stabilizer is disposed so that said stabilizing portion is positioned near and downstream of an outlet of said fuel air remixing device, and mounted on an inside of said combustor by a mounting device said mounting device comprising a plurality of members each radially extending and secured to the inside of said combustor at ends thereof and having a section slidably fitted in one of said openings formed in said cylindrical part to restrict axial movement of said stabilizer while allowing deformation due to thermal stress and another section of each of said members to restrict radial movement of said stabilizer.

15. A gas turbine combustor according to claim 14, wherein said another section of each of said plurality of members is formed as a support portion supporting an inside of said cylindrical part at an upstream side of said hole.

16. A gas turbine combustor according to claim 15, wherein said fuel air mixing device comprises outer and inner cylinders defining therebetween a fuel air mixture passage, said plurality of members each extending axially and being secured to said outer and inner cylinders at ends thereof.

* * * * *